US006739376B1

(12) United States Patent
Cheng et al.

(10) Patent No.: US 6,739,376 B1
(45) Date of Patent: May 25, 2004

(54) METHOD FOR PRODUCING A GOLF CLUB HEAD

(75) Inventors: Bernard Cheng, Kaohsiung (TW); Hsiao-Kun Chen, Kaohsiung (TW); Tony Chen, Kaohsiung (TW); May Lin, Feng-Shan (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 0 days.

(21) Appl. No.: 10/309,094

(22) Filed: Dec. 4, 2002

(51) Int. Cl.[7] ..... B22C 7/02; B22C 9/04

(52) U.S. Cl. ..... 164/35; 164/45; 164/516

(58) Field of Search ..... 164/34, 35, 45, 164/516, 235, 244, 246

(56) References Cited

U.S. PATENT DOCUMENTS 4,651,799 A * 3/1987 Chandley ..... 164/35
5,346,218 A * 9/1994 Wyte ..... 473/346
5,595,234 A * 1/1997 Beck ..... 164/9

FOREIGN PATENT DOCUMENTS

JP 5-104197 * 4/1993 ..... B22C/7/02

* cited by examiner

*Primary Examiner*—Kiley Stoner
*Assistant Examiner*—Kevin P. Kerns
(74) *Attorney, Agent, or Firm*—Fei-Fei Chao; Venable LLP

(57) ABSTRACT

A method for producing a golf club head includes preparing at least two wax models for the golf club head; combining the at least two wax models; coating the combined wax models with a layer of sand mortar to form a sand mortar mold; removing the wax from the sand mortar mold; pouring molten liquid into the sand mortar mold; breaking the sand mortar mold to leave a metal golf club head. The metal golf club head is further cut off any surplus metal and polished to complete a one-piece metal golf club head.

2 Claims, 7 Drawing Sheets

METHOD FOR PRODUCING A GOLF CLUB HEAD

BACKGROUND OF THE INVENTION

1. Field of the Invention

The present invention relates to a method for producing a golf club head, and more particularly to a method for producing a durable, one-piece golf club head with no joint between the body and the faceplate of the golf club head.

2. Description of Related Art

Conventional golf club heads are made in various types to accommodate a golfer's need to hit a golf ball different distances with different trajectories. The various types of golf club heads include woods, irons and putters. With reference to FIGS. 10 and 11, the conventional golf club head (5) is composed of a body (50) and a faceplate (60). The body (50) has a front opening (51), a rear opening (53), a tapered cavity (52) and a recessed seat (511). The tapered cavity (52) is defined in the body (50) to communicate between the front opening (51) and the rear opening (53). The recessed seat (511) is defined around the inner edge of the front opening (51). The faceplate (60) is attached to the body (50) by placing the faceplate (60) into the recessed seat (511), welding the faceplate (60) to the body (50) and grinding and polishing the welded joint to achieve a complete conventional golf club head (5).

When manufacturing the body (50) and the faceplate (60), a body mold and a faceplate mold are obtained first. Then, liquid wax is poured into the body mold and the faceplate mold to shape wax models of the body and the faceplate. Respectively, the wax body and the wax faceplate are dipped into sand mortar to coat the wax models with sand shells and form sand mortar molds. After the sand shell dries and hardens, the sand shells become sand mortar molds and are heated to melt the wax models. The wax is poured out of the sand mortar molds for the body and the faceplate of the golf club head. Molten metal is poured into the sand mortar molds to form the body and the faceplate of the golf club head respectively. When the metal cools and solidifies, the sand mortar molds are broken to remove the body and the faceplate. Finally, the metal body and faceplate are welded together, ground and polished to form a golf club head having a neat appearance.

The body (50) and the faceplate (60) have to be produced separately, because the body (50) is tapered to reduce air friction and has the tapered cavity (52) defined inside the body (50). When forming the wax models for the golf club head, the wax mold cannot be separate from the wax model via the rear opening (53) if the wax body and the wax faceplate are formed in a single mold. Therefore, the wax body and the wax faceplate have to be produced separately to shape the metal body (50) and the metal faceplate (60).

The golf club head made by welding has a joint between the body (50) and the faceplate (60) that causes the golf club head to break easily at the joint and not be durable. Moreover, welding the faceplate (60) to the body (50) to form the golf club head raises the production cost of the golf club head.

To overcome the shortcomings, the present invention provides a method for producing a golf club head to mitigate or obviate the aforementioned problems.

SUMMARY OF THE INVENTION

The main objective of the present invention is to provide a method for producing a one-pieced golf club head.

Further benefits and advantages of the present invention will become apparent after a careful reading of the detailed description with appropriate reference to the accompanying drawings.

DETAILED DESCRIPTION OF THE INVENTION

Figure 1:
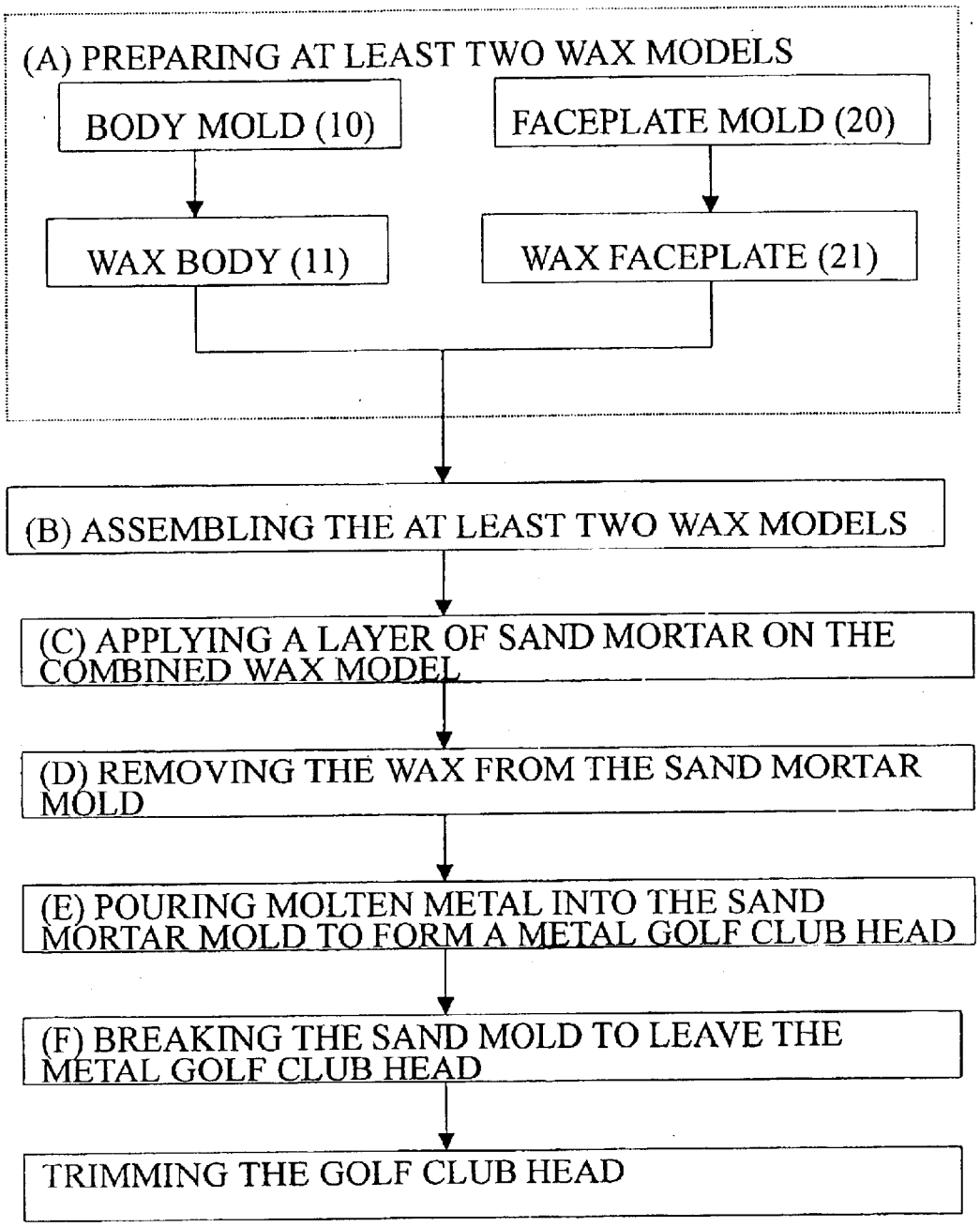
FIG. 1 is a block diagram of a method for producing a golf club head in accordance with the present invention.
Figure 2:
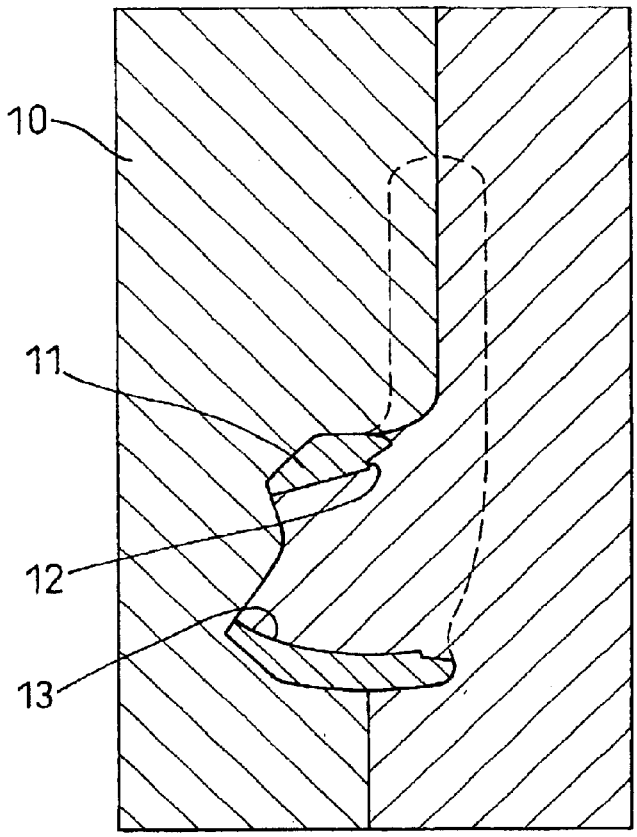
FIG. 2 is a cross-sectional side plan view of a mold to form a wax body.
Figure 3:
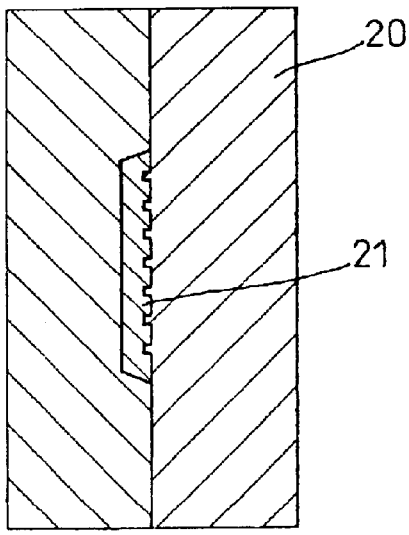
FIG. 3 is a cross-sectional side plan view of another mold to form a wax faceplate.

With reference to FIGS. 1, 2, and 3, a method for producing a golf club head comprises steps of (A) preparing wax body and faceplate models for a golf club head, (B) assembling the wax models, (C) coating the assembled wax model with a layer of sand mortar to form a sand mortar mold, (D) removing the wax from the sand mortar mold, (E) pouring molten metal into the sand mortar mold and (F) breaking and removing the sand mold.

In step (A), a body mold (10) and a faceplate mold (20) are obtained first, and wax liquid is poured into the body mold (10) and the faceplate mold (20) to form a wax body (11) model and a wax faceplate (21) model.

Figure 4:
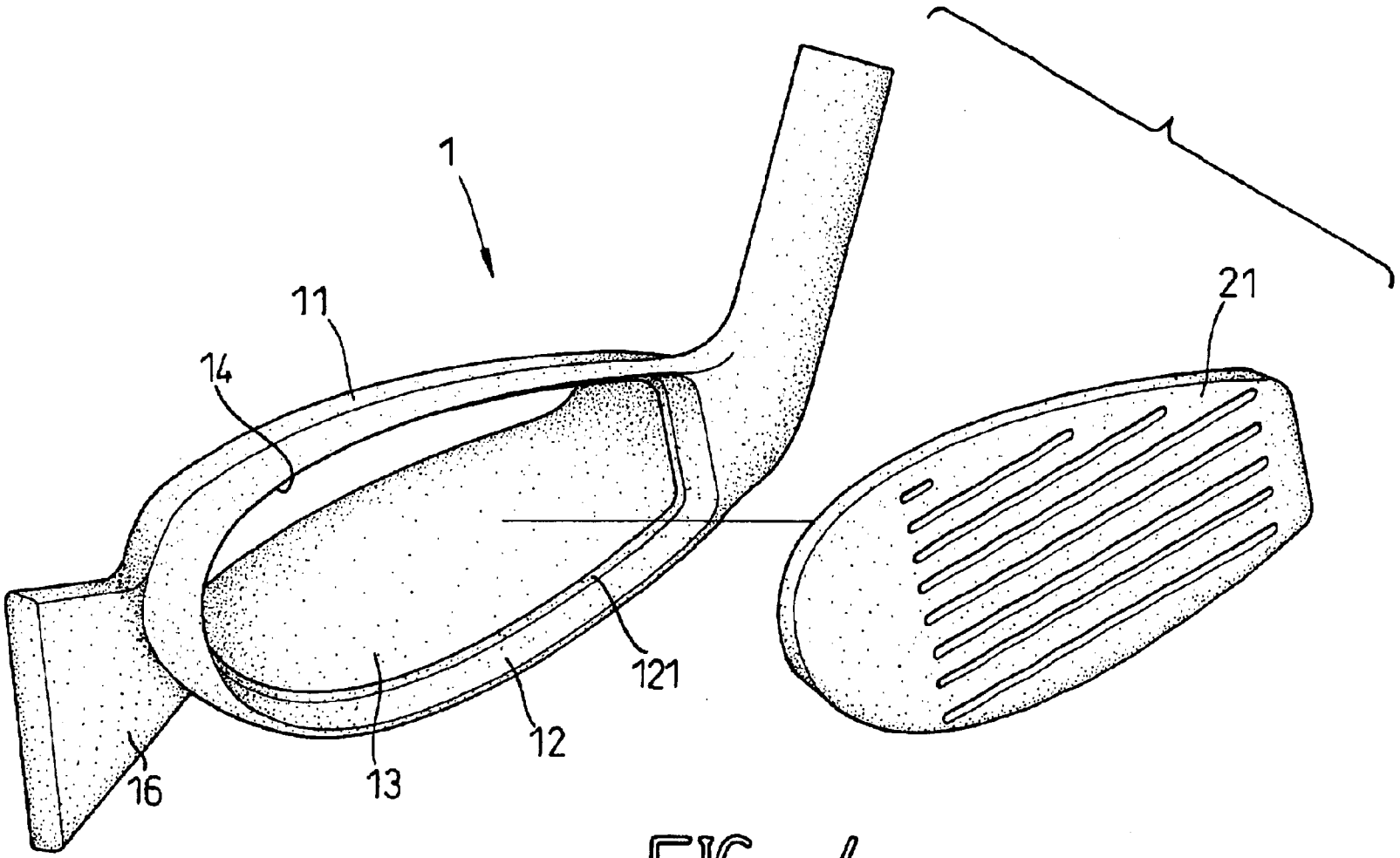
FIG. 4 is an exploded perspective view of the wax body connected to the wax faceplate.

With further reference to FIG. 4, the wax body (11) has a front opening (12), a rear opening (14), a tapered cavity (13) and a recessed seat (121). An inner edge (not numbered) is formed around the front opening (12). The tapered cavity (13) is defined in the body (11) to communicate between the front opening (12) and the rear opening (14). The recessed seat (121 ) is defined in the inner edge around the front opening (12). Additionally, a cone (16) is formed on one end of the wax body (11). The wax faceplate (21) corresponds to the front opening (12).

Figure 5:
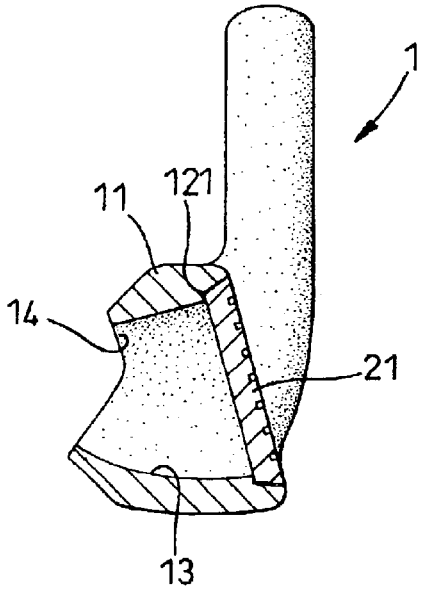
FIG. 5 is a cross-sectional side plan view of the wax body connected to the wax faceplate.

With further reference to FIG. 5, the wax faceplate (21) is combined with the wax body (11) in step (B) by pressing the wax faceplate (21) into the recessed seat (121) to form a one-piece wax model (1) of a golf club head.

Figure 6:
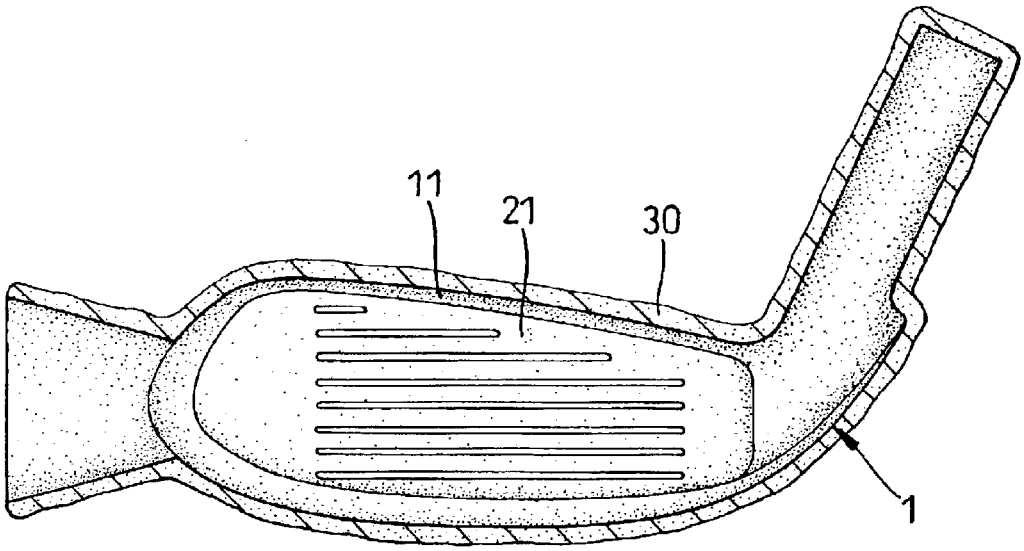
FIG. 6 is a cross-sectional front plan view of a wax club head coated with a layer of sand mortar.

With further reference to FIG. 6, the wax model (1) is dipped into sand mortar in step (C) to apply a layer of sand mortar (30) to form a sand mortar mold (3) around the wax model (1).

The cone (16) on the wax body (11) forms a pouring flute (32) in the sand mortar mold (3). When the wax model (1)

is heated and the wax is melted to a liquid in step (D), the liquid wax is poured out of the sand mortar mold (3) through the pouring flute (32) to empty the sand mortar mold (3).

Figure 7:
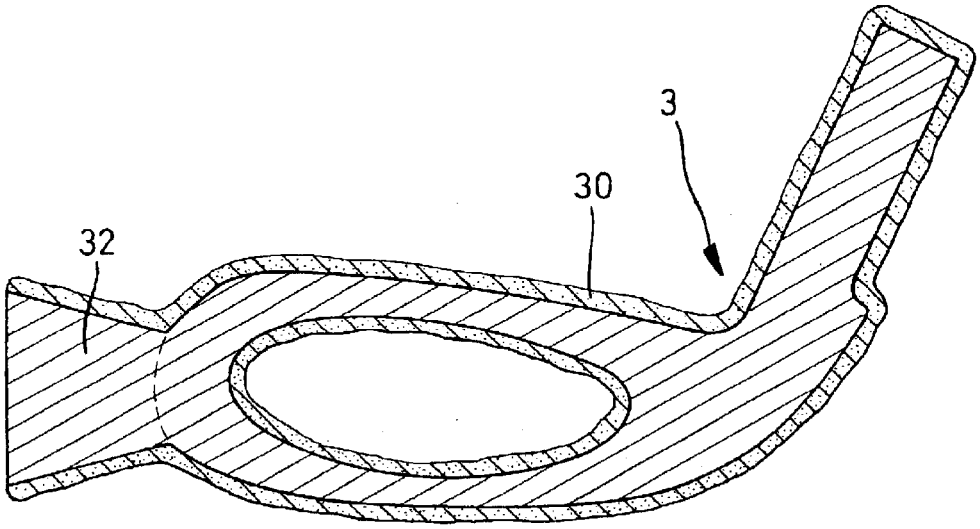
FIG. 7 is a cross-sectional front plan view of a sand mortar mold with the wax club head removed.
Figure 8:
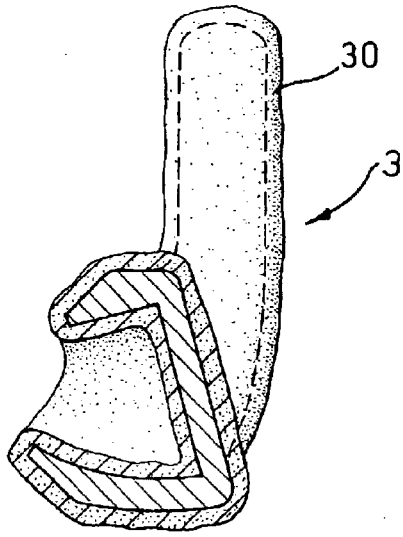
FIG. 8 is a cross-sectional side plan view of the sand mortar mold in FIG. 7.
Figure 9:
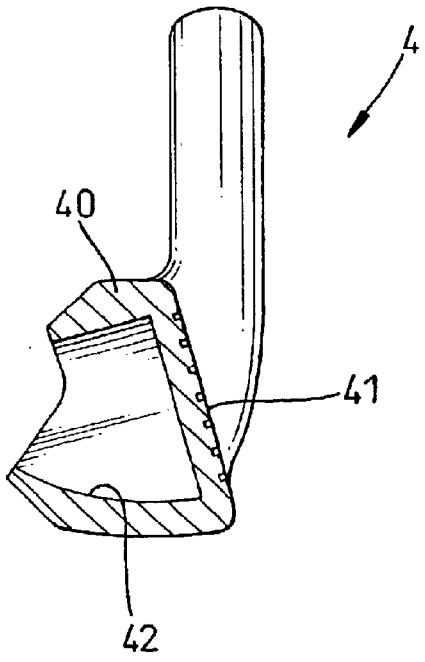
FIG. 9 is a cross-sectional side plan view of a metal club head formed from the sand mortar mold in FIG. 8.
Figure 11:
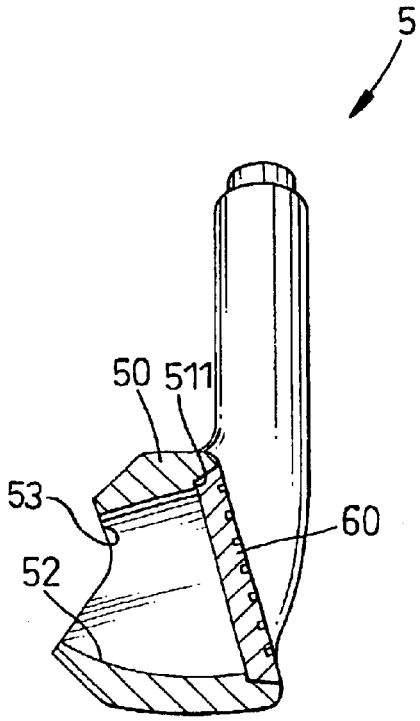
FIG. 11 PRIOR ART
FIG. 11 is a cross-sectional side plan view of the conventional golf club head in FIG. 10.
Figure 10:
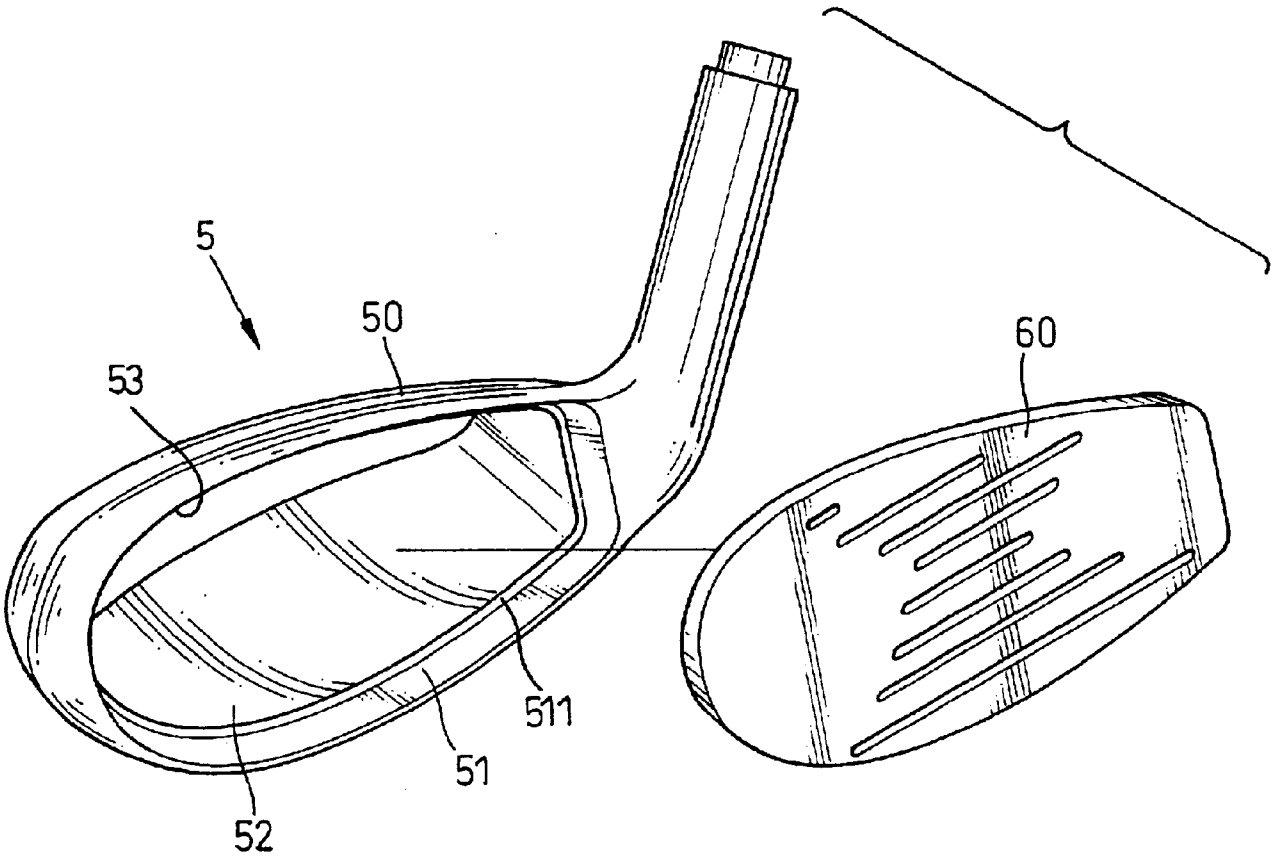
FIG. 10 PRIOR ART
FIG. 10 is an exploded perspective view of a conventional golf club head.

With further reference to FIGS. 7, 8 and 9, the sand mortar mold (3) is filled with molten liquid at a high temperature to shape a metal golf club head (4) in step (E) having a body (40) and a face portion (41) in one-piece with a tapered cavity (42). After the metal liquid cools and solidifies, the sand mortar mold (3) is broken in step (F) to leave the metal golf club head (4). Finally, a metal cone (not shown) corresponding to the pouring flute (32) is cut and trimmed off and polished to achieve a neat golf club head.

Because the sand mortar mold (3) is formed around an assembled wax model of the golf club head, the metal golf club head formed inside the sand mortar mold (3) is one-piece and does not have a joint between the body (40) and the face portion (41). Consequently, the one-piece golf club head is more durable than the conventional golf club head. Additionally, there is no need to weld the body and the faceplate as required with the conventional method for producing a golf club head, and the production cost is reduced.

It is to be understood, however, that the foregoing description is illustrative only to clarify the features of the method for producing heads of golf clubs, and should not be deemed to limit the scope of the invention.

What is claimed is:

1. A method for producing a golf club head having a tapered cavity defined in the golf club head, the method comprising the following steps:

preparing at least two wax models for the golf club head, wherein one wax model has a wax cone to form a pouring flute;

combining the at least two wax models together;

applying a layer of sand mortar to the combined wax models to form a sand mortar mold with a pouring flute corresponding to the wax cone;

removing the wax from the sand mortar mold via the pouring flute;

pouring molten liquid into the sand mortar mold to form a one-piece metal golf club head with a metal cone which is surplus; and breaking and removing the sand mortar mold to leave the one-piece metal golf club head;

wherein the metal golf club head is further cut off the metal cone corresponding to the pouring flute and polished points where the metal cone was removed to complete the one-piece golf club head.

2. The method for producing a golf club head as claimed in claim 1, wherein the at least two wax models for the golf club head are composed of a wax body and a wax faceplate;

wherein the wax body is tapered and has a front opening with an inner edge, a ear opening, a tapered cavity defined in the wax body to communicate between the front opening and the rear opening, and a recessed seat is defined in the inner edge of the front opening of the wax body; and the wax faceplate corresponds to the front opening in the wax body.

* * * * *